United States Patent [19]

Keller

[11] 3,992,792

[45] Nov. 23, 1976

[54] DATA CONVERSION APPARATUS

[76] Inventor: Hale C. Keller, 208 Echo Lane, Portola Valley, Calif. 94025

[22] Filed: July 2, 1975

[21] Appl. No.: 592,509

[52] U.S. Cl. ..... 40/70 R; 35/74

[51] Int. Cl.[2] ..... G09F 11/04

[58] Field of Search ..... 40/28 R, 70 R; 35/74; 116/133; 235/88, 78

[56] References Cited

UNITED STATES PATENTS

| | | | |
|---|---|---|---|
| 176,594 | 4/1876 | Burrow | 40/70 R X |
| 683,888 | 10/1901 | Bright | 40/70 R |
| 1,496,865 | 6/1924 | Aulmann | 40/28 R |
| 2,002,609 | 5/1935 | Mygland | 40/70 R X |
| 3,096,595 | 7/1963 | Elwood | 40/70 R X |

*Primary Examiner*—Ulysses Weldon

[57] ABSTRACT

An information storage and display apparatus is described. The apparatus comprises a hand-held container having a bottom member and a cover for storing a plurality of information-bearing discs. Within the container, a pedestal means is provided for supporting the discs individually in a position adjacent to a viewing aperture in the cover. The cover is manually rotatable relative to the bottom member and a disc supported on the pedestal for viewing selected portions of the disc.

16 Claims, 10 Drawing Figures

DATA CONVERSION APPARATUS

BACKGROUND OF THE INVENTION

The present invention relates to information storage and retrieval apparatus in general, but, more specifically, to a hand-held, manually-operable apparatus suitable for the storage and retrieval of information on discs, such as numerical tables, formulas, conversion tables and the like.

Students, engineers, pilots, housewives and many other categories of persons frequently have need of information which may be presented conveniently in graphic or tabular form. An example of one such need is a conversion table for the Englishmetric system. Another example might well be a table of numerical constants.

Heretofore, data conversion, for example, as employed by students, engineers, pilots, housewives and the like has required the use of books, tables and a variety of devices employing sliders or discs arranged in a slide rule like fashion.

So far as is known, however, no device is now available or has been proposed in which a plurality of data discs, sliding members, or the like are conveniently stored in a single device for selective individual use in solving different information source and conversion problems. If a student has had a need for different types of information, he has been required to use a variety of books and tables. Because these things are generally bulky, they are frequently inconvenient to carry around and, consequently, not always readily available when needed. Also, when a particular table or type of information is required, it is frequently necessary to purchase or use a source which contains a great deal of other information which is not required or is required only once in a while. This leads to needless expense and inconvenience.

SUMMARY OF THE INVENTION

In view of the foregoing, a principal object of the present invention is a small, hand-held, manually-operable, light-weight and relatively inexpensive information storage and retrieval apparatus which eliminates or at least significantly reduces the inconvenience and needless expense associated with equivalent prior known information sources.

A principal feature of the invention is a hand-held container in which may be stored a plurality of discs. The container includes a rotatable cover. Each disc bears information of the type frequently required to be used. The information on a disc is typically in tabular form, such as a conversion table. Other forms, such as graphic representations, may also be used. Inside the container, there is provided a pedestal. The pedestal is supported on one end and has one end free. When a particular type of information is required, the disc bearing that information is removed from among other discs retained about the pedestal and placed on the free end of the pedestal in a position adjacent to a viewing window in the cover of the container. The cover may then be rotated for viewing selected portions of the disc. Means are also provided on each of the discs and pedestal for immobilizing the disc while it is being viewed.

Since the number and selection of discs will be tailored to individual needs, discs may be fabricated, packaged and sold separately, as in the fashion of photographic slides at historical parks and other places of interest. Thus, students may purchase and use one set of discs tailored to their individual needs while an engineer, pilot and housewife will generally employ sets of discs bearing other types of information as is unique to and frequently required in their activities. Discs used only infrequently may be stored separately or, if room permits, they may also be stored in the container.

DESCRIPTION OF THE DRAWINGS

The above and other objects, features and advantages of the present invention should become more apparent in the following detailed description of the accompanying drawings in which.

DETAILED DESCRIPTION

Figure 1:
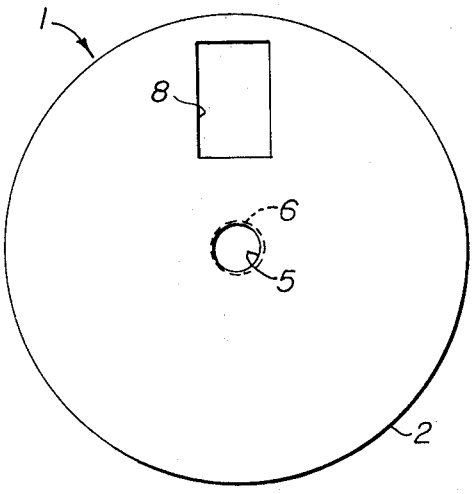
FIG. 1 is a plan view of a preferred embodiment of the present invention.
Figure 2:
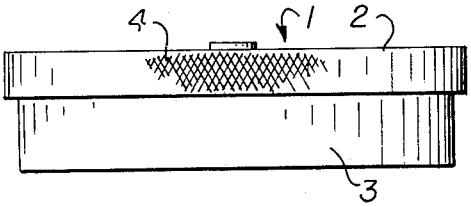
FIG. 2 is an elevation view of the apparatus of FIG. 1.

Referring to FIGS. 1 and 2, there is provided in accordance with the present invention a relatively shallow, handsized tubular container 1 having a top cover member 2 and a bottom member 3. Both top and bottom members 2 and 3 are generally cylindrical and are removably fitted together in a fashion permitting rotation of the top member 2 relative to the bottom member 3. To facilitate rotation of the top member 2, the top member 2 is typically provided with an overhanging, downwardly-depending side edge portion 4 which is knurled or otherwise roughened. In addition, there is provided in the top member 2, a viewing aperture or window 8. As shown in FIG. 1, there is also provided in cover member 2 an axial bore 5. In the interior of bore 5 there is provided an annular recess 6 which is employed for rotatably coupling the cover 2 to the bottom member 3, as will be described below.

Figure 3:
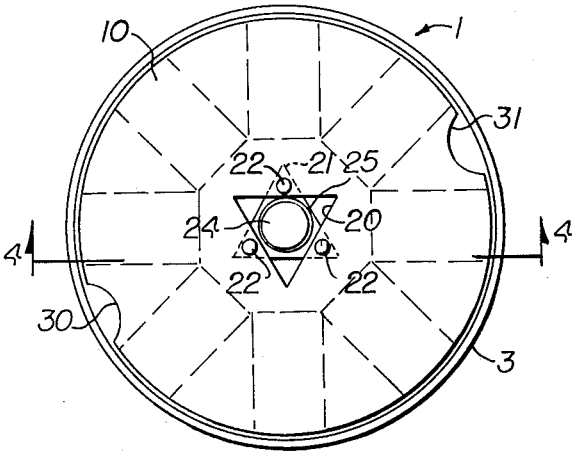
FIG. 3 is a plan view of the apparatus of FIG. 2 with the cover removed.
Figure 4:
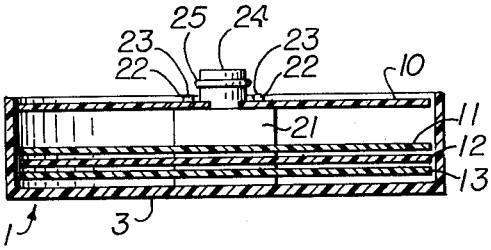
FIG. 4 is a cross-section view in the direction of the lines 4—4 of FIG. 3.
Figure 9:
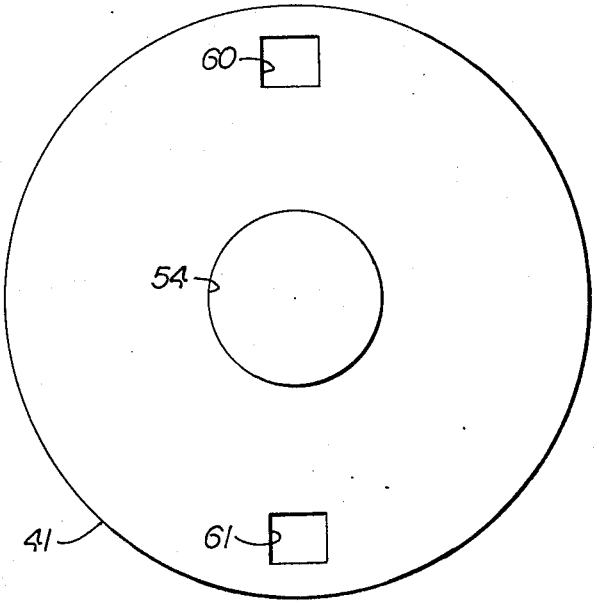
FIGS. 9 and 10 are alternative embodiments of data disc members in accordance with the present invention.
Figure 10:
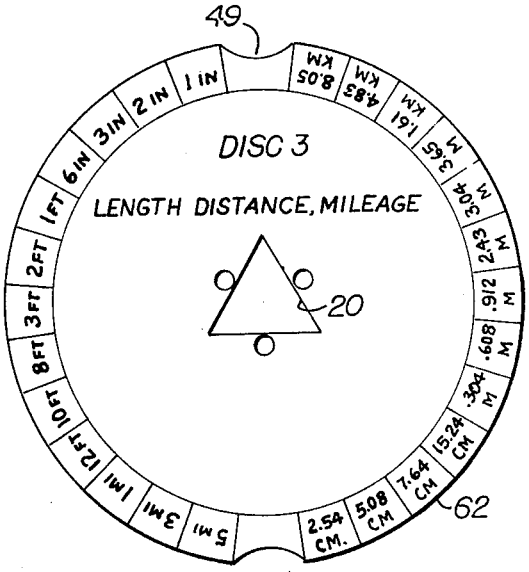

Referring to FIGS. 3 and 4, there is provided for storage in container 1 a plurality of data discs 10, 11, 12 and 13. The discs 10–13, as more fully described with respect to FIGS. 9 and 10, are each provided with an equilateral, triangularly-shaped axial bore or aperture 20. Extending axially from the base or bottom interior surface of bottom member 3 and having a free end is an identically shaped shaft or pedestal 21 having somewhat shorter sides for freely receiving the discs 10–13. The shape of the pedestal 21 is chosen such that all of the discs may be slidably fitted over the pedestal when the edges of the disc apertures and pedestal sides are coincident.

Extending from each corner of the shaft 21 is a pin 22 provided with a hemispherically-shaped end surface 23 for engaging a corresponding hole along a side of the aperture 20 in the discs. Also extending from shaft 21 intermediate pins 22 is a spindle 24. Adjacent the end of spindle 24 is an annular boss or extended portion 25 for releasably engaging the recess 6 in the cover 2.

In use, the cover 2 is removed from container 1 as by popping the cover from the bottom member 3. This exposes the discs 10–13. The discs are then removed from the container as by inverting and shaking the container or by grasping the discs using a pair of finger recesses 30 and 31 provided in the periphery of the discs. Once the discs are removed and a single disc is selected therefrom, the remaining discs are returned to the container and the selected disc, such as disc 10, is rotated slightly and placed on the free end of the pedestal 21 with its holes aligned with the pins 22. While shafts of other shapes could be used, the equilateral shape of the shaft 21 is chosen for its simplicity and to facilitate placement of the discs on the shaft in any one of three positions with a minimum expenditure of time and trouble. As can be seen clearly in FIG. 3, the triangular shape of the pedestal 21 also provides a stable three-point support for the disc placed on its free end.

The fit between cover 2 and container 1 should be relatively free but with sufficient friction between the two so as to minimize free rotation of the cover relative to the container in the absence of a deliberate attempt to rotate the cover. For this purpose, the length of pins 22 may be chosen such that the pins bear against the interior surface of the cover 2 when the cover is "snapped" onto the container. Other suitable motion-retarding means may, of course, be employed.

When the discs and cover are in place, the cover 2 may be rotated relative to the container to expose selected data on the disc 10 for viewing through the window 8.

Figure 5:
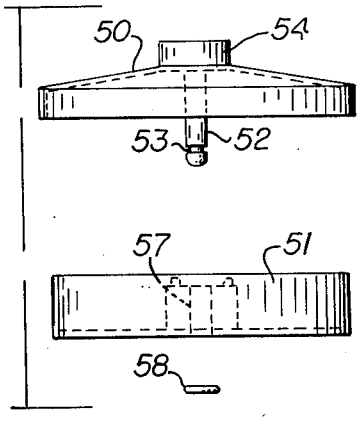
FIG. 5 is an exploded view of an alternative embodiment of the present invention.
Figure 6:
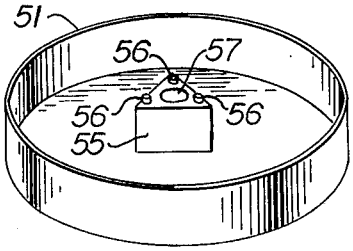
FIG. 6 is a perspective view of the bottom member of FIG. 5.

Referring to FIGS. 5 and 6, there is provided an alternative embodiment of the present invention comprising a cover 50 and a bottom member 51. Extending downwardly from the interior of the cover 50 is a spindle 52. Spindle 52 is terminated at its free end by an annular recess 53. Extending from the exterior of the cover 50 and coaxial with the spindle 52 is a knob 54. Knob 54 is provided for facilitating rotation of the cover 50 with respect to the bottom member 51. Knurling of the knob may also be employed to facilitate this rotation. In the interior of the bottom member 51, as seen in FIG. 6, is a pedestal 55. Pedestal 55 is also provided to have, preferably, an equilateral triangular shape and is also provided with a plurality of aligning pins 56 extending from its free end. Axially disposed in the pedestal 55 is a bore 57 for receiving the spindle 52. After insertion of a plurality of discs in the bottom member 51 and the placement of at least one of the discs on the pedestal 55, as described with respect to FIGS. 3 and 4, the cover 50 is placed on the bottom member 51 and rotatably secured thereto as by a resilient O-ring 58 which engages the recess 53. For viewing a disc supported on the pedestal 55, there is also provided in the cover 50 a window or aperture of the type described and shown in FIG. 1.

The cover members 2 and 50 of FIGS. 1 and 5 are described as comprising a single viewing window or aperture. In practice, however, more than one aperture may be used.

Figure 7:
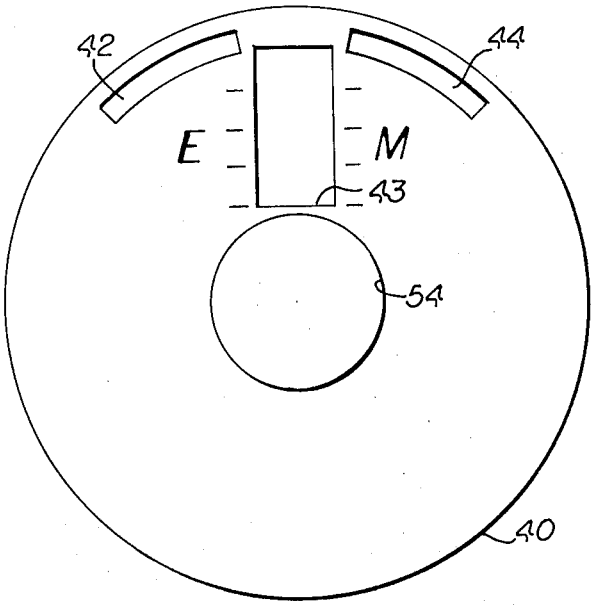
FIGS. 7 and 8 are alternative embodiments of cover members in accordance with the present invention.
Figure 8:
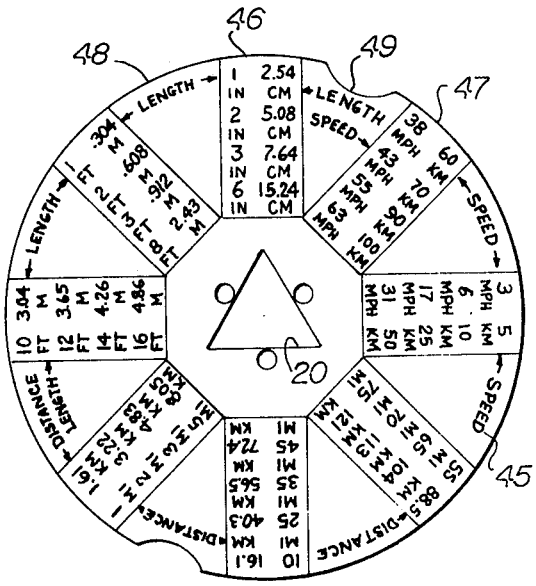

Referring to FIGS. 7 and 8, there is shown a pair of alternative cover members 40 and 41. In cover 40 there are provided three apertures 42, 43 and 44. Apertures 42 and 44 may be used for viewing identifying indicia, while aperture 43 may be used for viewing the information identified in either of the apertures 42 and 44. As shown in FIG. 9, a disc 45, having the same shape as the discs 10–13 of FIGS. 3 and 4, may have the desired information arranged in tabular form in a plurality of tables 46, 47, etc. Between the tables may be located identifying information such as that shown at 48 and 49. The utility of using a plurality of apertures arranged as shown in FIG. 7, with the disc of FIG. 9, is readily apparent in that the information displayed in aperture 43 is readily identified in either or both apertures 42 and 43.

In FIG. 8, there is provided still another arrangement in which the cover 41 is provided with a pair of radially disposed apertures 60 and 61.

In FIG. 10, there is shown a disc 62 on which the desired information is placed in opposing positions about the periphery of the disc. In use, for example, if one centers the information "1 in." in one window, the metric equivalent, "2.54 cm" will appear in the opposite window.

From the foregoing, it is obvious that still other arrangements of viewing windows may be employed with other variously arranged discs and that other types of locking means may be used for rotatably securing a cover to a bottom member in accordance with the present invention without departing from the spirit and scope of the present invention. It is, therefore, understood that the above description of the present invention is intended only for purpose of illustration and that the scope of the invention should not be limited thereto but should be determined by reference to the claims hereinafter provided.

What is claimed is:

1. An information storage and display apparatus comprising:

means forming a container, said container having a top and a bottom member;

a pedestal centrally located within said container, said pedestal being supported at one end and having one end free with a disc-supporting surface extending generally perpendicular to the longitudinal axis thereof for receiving and supporting a disc;

a plurality of discs, each disc having a centrally located aperture, said aperture having a size and shape corresponding to the size and shape of the cross-section of said pedestal in a plane perpendicular to its longitudinal axis, for allowing the threading of said pedestal through said discs to store said discs about said pedestal when they are not in use;

means extending from said disc-supporting surface for retaining at least one of said plurality of discs on said surface when said latter disc is removed from among said plurality of discs and placed on said surface; and means for indexing selected portions of said latter disc as a visual aid when viewing said selected portions.

2. An apparatus according to claim 1 wherein said top and said bottom members have coaxial longitudinal axes and are rotatably coupled together for allowing said top member to be rotated relative to said bottom member about said longitudinal axes, said pedestal is fixed to said bottom member, and further wherein said indexing means is located in said top member for rotation with said top member relative to said pedestal and a disc retained on the free end thereof.

3. An apparatus according to claim 2 wherein said indexing means is a viewing aperture located in a wall of said top member for selectively viewing selected segments of a disc supported on said free end of said pedestal as said top member is rotated.

4. An apparatus according to claim 3 wherein said free end of said pedestal comprises a flat surface and said retaining means comprises first means fixed to said flat surface and second means on each of said discs which cooperate for retaining a disc placed on said free end in a fixed angular position relative thereto when said top member is moved relative to said disc.

5. An apparatus according to claim 4 wherein said first means comprise pin means extending from said flat surface and said second means comprises aperture means adapted for receiving said pin means.

6. An apparatus according to claim 5 wherein said cross-section of said pedestal is triangularly shaped and said aperture means adapted to receive said pin means comprises a hole located along the edges of said triangularly-shaped aperture in a position between its apexes corresponding to the position of said pin means.

7. An information storage and display apparatus comprising:

a containing means including a centrally located pedestal for receiving a pile of discs, said pedestal having a longitudinal axis and a non-circular cross-sectional shape in a plane perpendicular to said axis and a disc-supporting surface extending generally perpendicular to the longitudinal axis thereof for receiving and supporting a disc, each of said discs having a centrally located aperture corresponding in shape to said cross-sectional shape of said pedestal for non-rotatable, removable, slidable mounting over said pedestal;

cooperable means on one end of said pedestal extending from said disc-supporting surface and on each of said discs for holding any given disc on said end of said pedestal in a fixed angular position relative to said pedestal when said disc is removed from said pedestal and supported on said end of said pedestal; and means movable relative to a disc supported on said free end of said pedestal for indexing said disc.

8. An apparatus according to claim 7 wherein said containing means comprises means forming a tubular container having a movable wall for enclosing said pedestal and any discs mounted thereon and wherein said indexing means comprises a viewing aperture in said movable wall for viewing a portion of a disc placed in registration with said viewing aperture; and further comprising means for moving said movable wall relative to a disc supported on said end of said pedestal for permitting selective viewing of different portions of said disc as said viewing aperture is moved relative thereto.

9. Apparatus according to claim 7 wherein said one end of said pedestal comprises a flat surface, and said cooperable means on said one end of said pedestal and on each of said discs comprises, respectively, an aligning pin means extending from said flat surface, and a corresponding aligning pin-receiving hole means in each of said discs located in a position adjacent to said aperture for receiving said aligning pin means.

10. A disc storage and display apparatus comprising a tubular container; a base member located at one end of said container, a pedestal within said container extending upright from said base member, said pedestal having a longitudinal axis, a disc-supporting surface extending generally perpendicular to said axis for receiving and supporting a disc and a non-circular cross-sectional shape in a plane normal to said axis; a pile of discs, each of said discs having an aperture of the same shape as said pedestal for non-rotatable, removable mounting over the pedestal; a plurality of radially arranged indicia on each of said discs, and cooperable means on the top of the pedestal extending from said disc-supporting surface and on each of said discs for holding any given disc in a fixed angular position relative to said pedestal when it is removed from the pile and supported on the top of the pedestal, and an indexing means on the container with respect to which said indicia may be oriented.

11. An information display apparatus comprising:

a means for receiving a plurality of disc members, each of said disc members having a centrally located aperture;

means forming a pedestal within said receiving means, said pedestal means having a free end portion comprising a disc-supporting surface extending generally perpendicular to the longitudinal axis thereof and an elongated body portion, said body portion having an exterior shape corresponding to the shape of said aperture in each of said disc members for allowing the threading of said pedestal through said aperture when the edges of said aperture have a first orientation with respect to said body portion and for preventing the threading of said pedestal through said aperture when the edges of said aperture have a second orientation with respect to said body portion;

means for retaining at least one of said disc members on said free end of said pedestal when the edges of said aperture of said disc member have said second orientation with respect to said body portion;

means for indexing a disc retained on said free end of said pedestal; and means for revolving said indexing means with respect to said disc retained on said free end of said pedestal for selectively indexing selected portions of said disc.

12. An apparatus according to claim 11 wherein said shape of said body portion of said pedestal in a plane perpendicular to the longitudinal axis of said pedestal and the shape of said aperture in each of said disc members is a non-circular shape.

13. An apparatus according to claim 12 wherein said non-circular shape is a triangular shape.

14. An apparatus according to claim 12 wherein said first orientation of said edges of said aperture with respect to said body portion comprises an orientation which exists when the edges of said aperture are congruent with the edges of said body member and said second orientation of said edges of said aperture with respect to said body portion comprises an orientation which exists when the edges of said aperture are incongruent with the edges of said body member.

15. An apparatus according to claim 14 wherein said retaining means for retaining at least one of said disc members on said free end of said pedestal comprises an aligning and retaining pin means extending from said free end, said pin means having a position with respect to the sides of said pedestal such that said pin means engages corresponding holes in each of said disc members when the edges of the aperture in said disc member are in their second orientation with respect to said body member.

16. An apparatus according to claim 15 wherein the body portion of said pedestal comprises surfaces which describe an equilateral triangle in a plane extending through and perpendicular to the longitudinal axis of said pedestal, said free end is correspondingly shaped, and said pin means extending from said free end of said pedestal extends from the vicinity of the apexes of said triangularly shaped free end.

* * * * *